United States Patent [19]

Hale et al.

[11] Patent Number: 4,470,278

[45] Date of Patent: Sep. 11, 1984

[54] LOCKSET

[75] Inventors: Paul F. Hale, Oakland; James R. Allison, San Francisco, both of Calif.

[73] Assignee: Schlage Lock Company, San Francisco, Calif.

[21] Appl. No.: 319,581

[22] Filed: Nov. 9, 1981

[51] Int. Cl.[3] ..... E05C 1/16

[52] U.S. Cl. ..... 70/134; 292/169.18; 292/359; 70/380

[58] Field of Search ..... 292/169.16, 169.18, 292/359, 150; 70/421, 380, 379, 134, 452

[56] References Cited

U.S. PATENT DOCUMENTS 2,064,955 12/1936 Singer et al. ..... 70/421 X 2,642,735 6/1953 Quigley ..... 70/380 X 3,916,656 11/1975 Schlage ..... 292/169.18 X

*Primary Examiner*—Richard E. Moore

*Attorney, Agent, or Firm*—Lothrop & West

[57] ABSTRACT

A lockset for a door has a strike on the door frame and a latch bolt on the door panel. The latch bolt is reciprocable and is projected by a spring and preferably has a deadlatch operation. The latch bolt is retractable by rotation of an inner knob or of an outer knob. The outer knob is locked by a key lock controlling an axially movable plate engaged with the outer knob and interengageable with an outer escutcheon adjacent the outer knob. The key lock can move the plate out of engagement with the outer escutcheon and into engagement with the inner knob. A turn button in the inner knob can also move the axially movable plate.

15 Claims, 26 Drawing Figures

163
2-
112
-17-
6
17
20
93
-17-
26
2-
3-
8
24
12
23
92
9
11
7
37
71
159
-3-

9
136
142
91
134
137
147
158
51
146
-6-
-6-
146
148
149
149
148
132
131
109
137
133
147
142
136
134

93
91
142
138
143
141
144
137
145
-7-
109
174
172
186
168
169
158
184
183
94
-7-
189
189
51
171
134
143
137

176
177
93
90
94
95
178
174
109
158
90
95
177
176

113
117
112
109
158
159
108
189
145
168
171
137
164
169
128
127
143
138
51
134
127
123
126
124
174
168
144
171
141

FIG-2
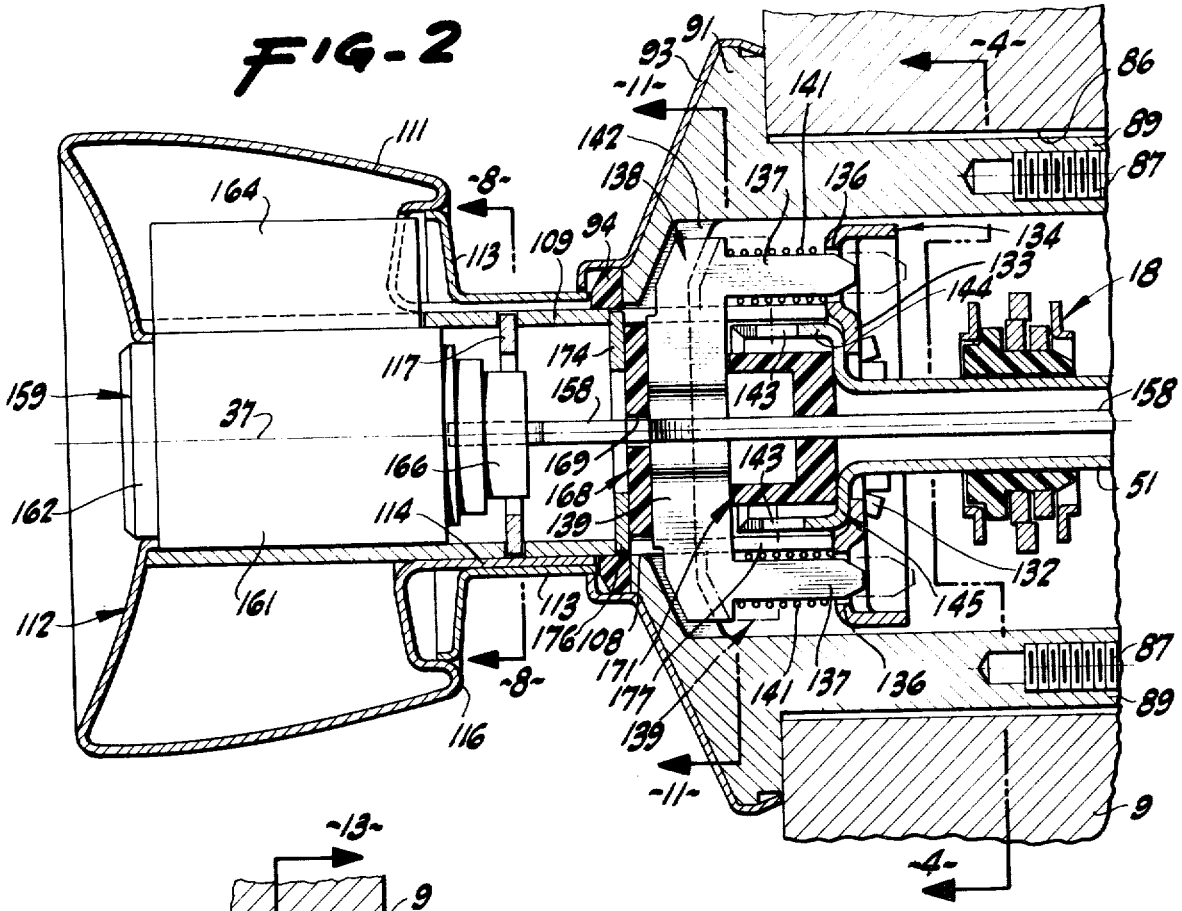
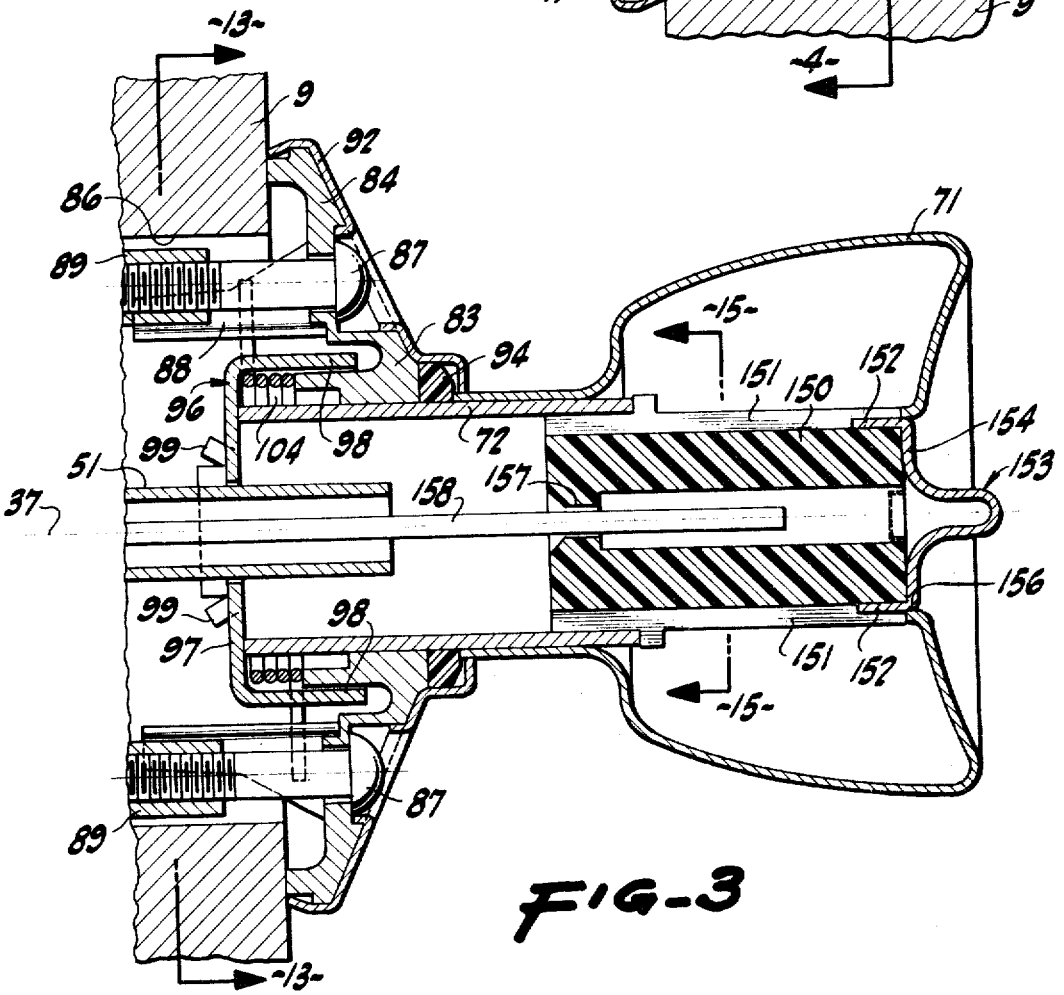
FIG-3

FIG-25
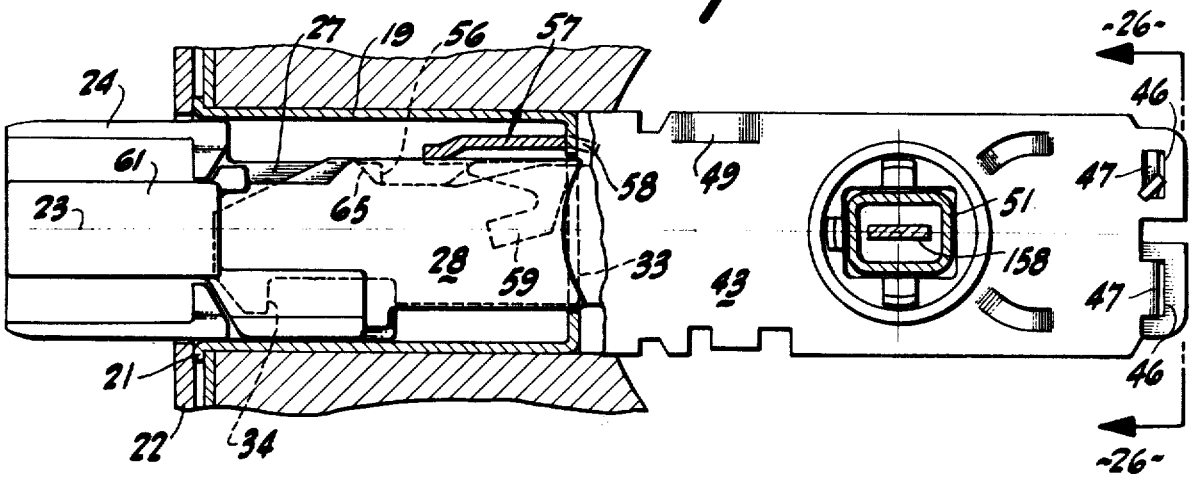
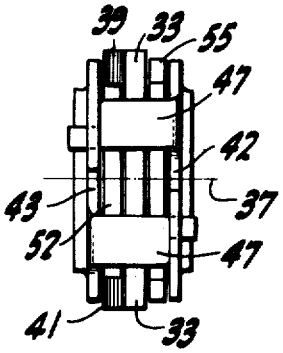
FIG-26

LOCKSET

BRIEF SUMMARY OF THE INVENTION

The lockset includes a strike unit for installation on a door frame and a lock unit for installation on a swinging door panel to engage with the strike unit. Inner and outer knobs actuate a latch bolt, the outer knob usually having a key control and the inner knob usually having a thumb-button control. A deadlock is preferably provided with the latch bolt. Security is attained by use of relatively few, simple parts, economical to manufacture and to assemble and repair.

BRIEF DESCRIPTION OF THE SEVERAL VIEWS OF THE DRAWINGS

FIG. 2 is a view to an enlarged scale, and with portions broken away, primarily showing in cross-section an exterior knob and environs, the plane of section being indicated by the line 2—2 of FIG. 1.

FIG. 3 is a view comparable to FIG. 2 and showing an interior knob and environs, the plane of section being indicated by the line 3—3 of FIG. 1.

FIG. 25 is a view similar to FIG. 19 but showing more of the parts in different positions and in side elevation.

FIG. 26 is an end view indicated by the line 26—26 of FIG. 25.

DETAILED DESCRIPTION

In constructing locksets there are various requirements and aims or preferences that it is desired to observe. It is, of course, desired to have a high degree of security consistent with the nature of the use. It is also desired to have a simple and economical construction not only to save time and cost in production, especially quantity production, but also for repairs and rebuilding with substantial multi-use parts for easy fabrication and conversion. It is deemed helpful to reduce the time and skill usually required in fastening parts together by screws or bolts and nuts and to use easier and faster securing means, and it is also helpful to reduce the number of different parts and to employ some cushiony and plastic parts. With these desiderata, there has been provided a corresponding lockset.

Figure 18:
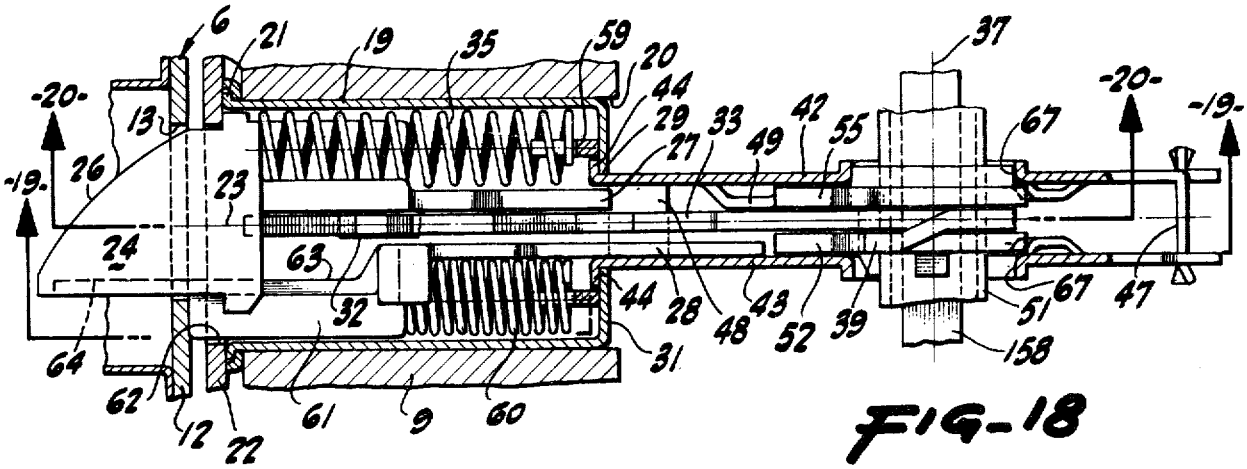
FIG. 18 is a cross-section, the planes of which are indicated by the lines 18—18 of FIG. 17.

The lockset of the invention includes a strike unit 6 and a lock unit 7 arranged for cooperation. The strike unit 6 is customarily mounted on a door frame 8 on which a door panel 9 is hung for swinging movement about a vertical axis by means of hinges 11. The strike unit 6 includes a strike plate 12 set into the frame 8 and fastened in place. The plate 12 has an opening 13 (FIGS. 18 and 20) affording access to a strike box 14 disposed in a recess 16 formed in the frame. Customarily, the strike plate 12 not only defines the opening 13, but likewise projects toward the hinge side of the panel 9. Included in the frame 8 is a door stop 17 to maintain the door panel, in its closed position, in alignment with the strike unit 6.

The lock unit 7 is inclusive of a generally separate but interrelated bolt structure 18 inclusive of a shell 19 designed to fit into an edge bore 20 in the panel 9 and usually having a stop rim 21 abutting a plate 22 set into the edge of the panel.

The shell 19 is generally circular cylindrical and is symmetrical about a horizontal axis 23. A bolt 24 housed in the shell is reciprocable within the shell 19 along the axis 23. The bolt may be blunt or square ended and without any cam surface, but preferably and in the present instance has a cam surface 26 cooperable with the strike plate 12. Fastened to the bolt 24 is a side guide plate 27 extending through an aperture 29 in the end wall 31 of the shell 19. This serves to position and guide the bolt. Extending from and fastened to the side guide plate 27 is a bridge 32. In lost-motion connection with the bridge is a retracting hook plate 33 having a nether slot 34 cooperative with the bridge 32 (FIGS. 18–21). With a limited lost motion, reciprocation of the plate 33 correspondingly reciprocates the bolt 24. Unless otherwise moved, the bolt is normally projected by means of a coil spring 35 seated against an inside face of the bolt itself and also against a lever arm at the end of the shell 19.

Figure 24:
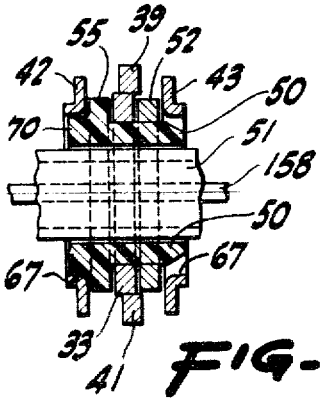
FIG. 24 is a cross-section, the plane of which is indicated by the line 24—24 of FIG. 19.

In order to impose a retracting force on the bolt, the hook plate 33 is axially extended beyond a cross axis 37. The hook plate has an elongated opening 38 in that region and then is displaced to provide a pair of offset abutments 39 and 41 (FIGS. 20 and 24) projecting toward one of a pair of side frame plates 42 and 43. These separate plates 42 and 43 are substantially identical. At one end each plate has a short, offset flange 44. This flange is hooked through the aperture 29 in engagement with the inside of the end wall 31 of the shell 19. Then the just-hooked plate is rotated to extend in an axial direction. When both side frame plates have been so positioned they are substantially parallel and their end abutments 45 bear against the outside of the end wall 31. In this way the plates 42 and 43 and the shell 19 are made axially immovable when assembled.

But preferably before the side plates are finally put into position, the separate hook plate 33 has its hooked end inserted through the aperture 29 and disposed in position to engage the bridge 32. Then the side plates are installed. Each of the guide plates has an aperture 46 therein designed to receive a tang 47 on the other plate. After insertion in the apertures 46, the tangs 47 are slightly twisted. This locks the two side plates 42 and 43 together with the hook plate 33 laterally confined between them. The two plates 42 and 43 are also provided with transversely spacing edge tabs 48 and have guide embossments 49 thereon. In this way, the side guide plates of a selected backset length and the related hook plate are changeable with other longer or shorter elements virtually as a sub-assembly in order at any time to change the backset dimension.

Figure 19:
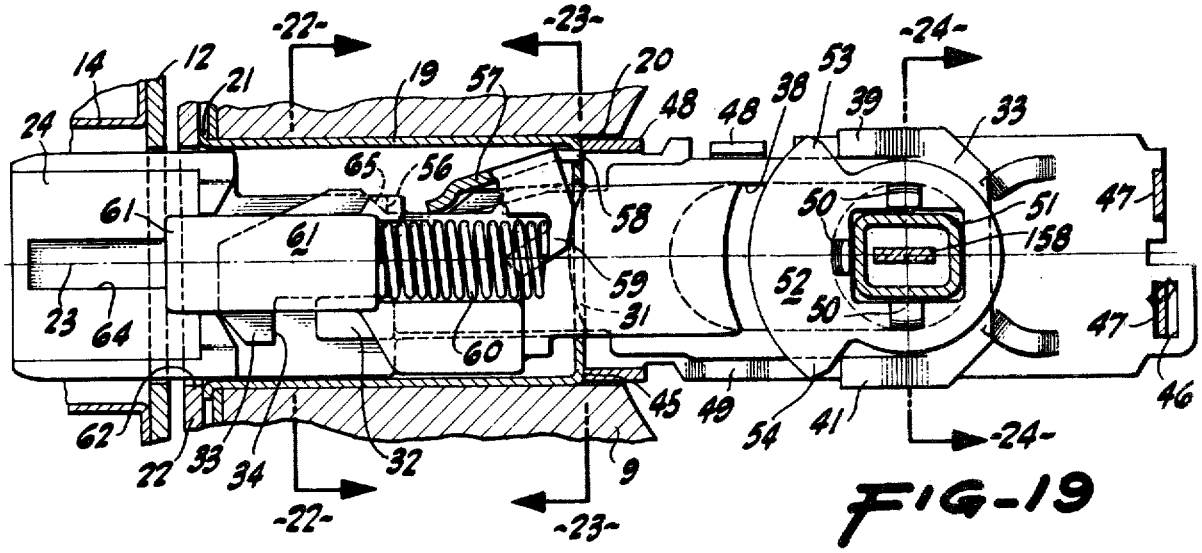
FIG. 19 is a cross-section, the planes of which are indicated by the lines 19—19 of FIG. 18.
Figure 20:
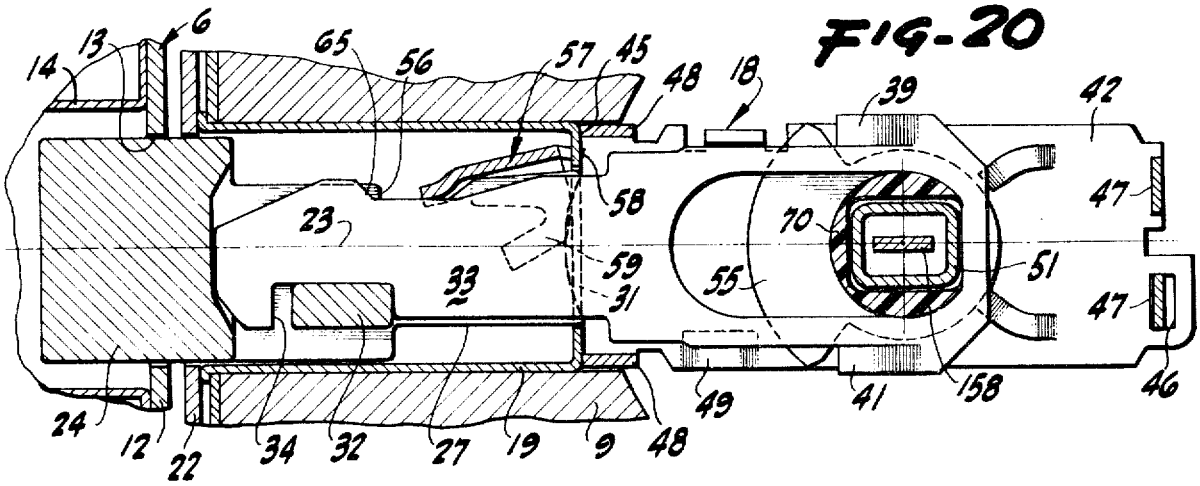
FIG. 20 is a cross-section, the plane of which is indicated by the line 20—20 of FIG. 18.
Figure 21:
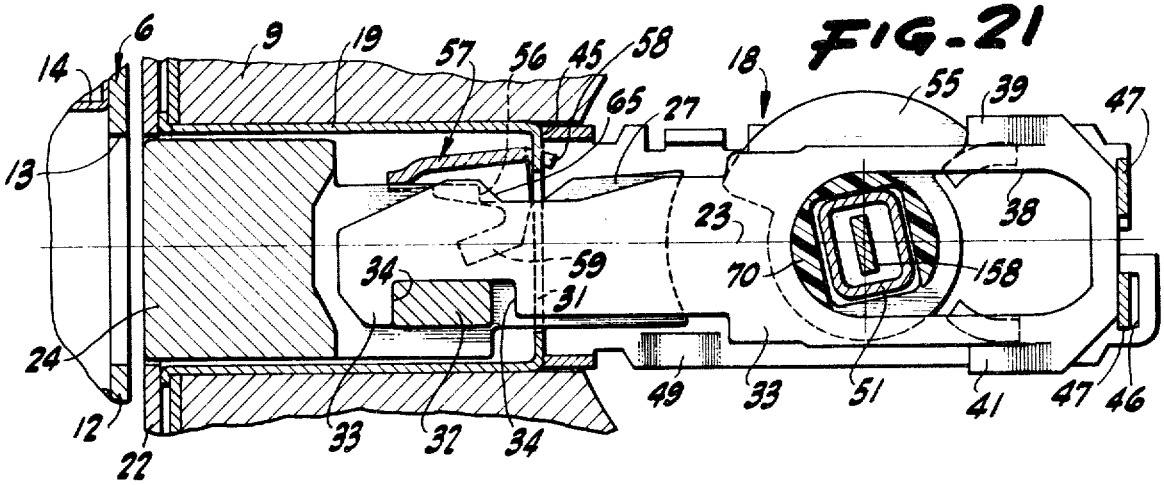
FIG. 21 is a cross-section like FIG. 20 but showing the parts in different positions.
Figure 22:
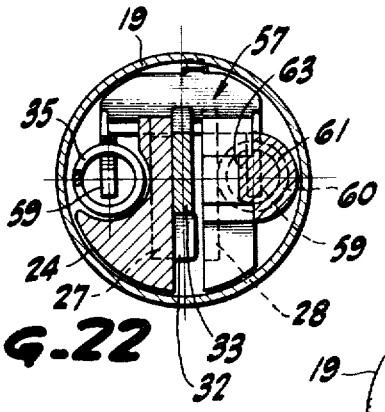
FIG. 22 is a cross-section, the plane of which is indicated by the line 22—22 of FIG. 19.
Figure 23:
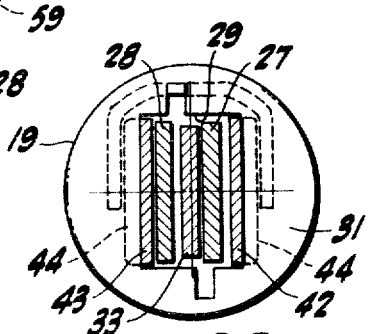
FIG. 23 is a cross-section, the plane of which is indicated by the line 23—23 of FIG. 19.

Means are provided for reciprocating the bolt 24 against the urgency of the spring 35. Rotatable about the cross axis 37 is a box tube 51. This engages in a rectangular opening in a preferably metallic cam 52 having cut-outs to receive tangs 50 projecting from the central hub of a similar, preferably plastic cam 55. The configuration of the cams 52 and 55, as especially shown in FIGS. 19, 20 and 21, is such that the cam lobes 53 and 54 of the effective cam 52 are coplanar with the offset abutments 39 and 41. When the box tube 51 is rotated in one direction, the lobe 53 contacts the end of the abutment 39 and so displaces the hook plate 33 to the right in FIGS. 20 and 21 for a sufficient distance to withdraw the bolt 24 and cock the spring 35. The hook plate, when withdrawn, is loosely guided between the embossments 49. Correspondingly, when the box beam is rotated in the opposite direction, the cam lobe 54 abuts the abutment 41 and withdraws the bolt 24. Thus, for either direction of rotation of the box beam, the bolt is withdrawn.

As so far described, the bolt 24 can not only be withdrawn, but by use of a special external tool can be "carded" or depressed or forced in against the spring 35. This is true even though the bolt 24 is within the strike box 14. A card or the like inserted between the door panel 9 and the frame 8 can be utilized to depress the latch bolt. To prevent such depression from outside when the door panel is in closed position, a deadlock mechanism is afforded. When the bolt is projected, the side guide plate 27 is likewise projected into a position so that a shoulder 56 (FIGS. 20 and 21) on the side guide plate is also advanced. In the retraction path of the shoulder, spanning or clearing the hook plate 33 and adapted to occupy a position in the path of substantial depression or retraction of the shoulder 56 is a deadlock lever 57 having a fulcrum 58 and a depending pair of arms 59 adapted in one position to seat on the end wall 31 and against one end of which an end of each spring 35 and 60 abuts. The other end of the spring 60 is in contact with a deadlatching plunger 61. The plunger passes through a corresponding cut-out 62 in the face plate 22 and has a portion 63 that is relatively flat and engages in a corresponding groove 64 in the side of the bolt 24. A guide plate 28 on the plunger extends along the side frame plate 43.

The deadlock lever 57 is urged by the compression spring 60 in a counterclockwise direction, in FIG. 19, to abut the upper edge of the side guide plate 27 unless otherwise lifted therefrom. When the lever 57 is pressed against the top of the side guide plate and, when the door is closed, if an effort is made externally to depress the bolt 24 (for example, in an attempt to force the lock), the bolt 24 can be depressed for only a short distance because the shoulder 56 soon abuts the end of the lowered deadlock lever 57, itself against the end wall 31. This arrests any further inward motion of the bolt and so prevents forcing of the lock by external pressure on the bolt with a closed door.

The bolt can readily be retracted by a force from within. When the box tube 51 is rotated about the cross axis 37 in either direction, one or the other of the cam lobes 53 and 54 contacts the respective abutment 39 or 41 and so displaces the hook plate 33 inwardly. Initially there is some lost motion, but shortly the hook 33 abuts the bolt bridge 32. Then the bridge 32 and the side guide plate 27 to which it is connected start to move inwardly in unison with the hook plate 33.

As the hook plate 33 moves inwardly, a cam face 65 at the top of the hook plate 33 engages and underrides the leading end of the deadlock lever 57. This rotates and lifts the lever 57 sufficiently to permit the shoulder 56 to ride beneath and not engage the lever 57. A full, unimpeded retraction of the bolt 24 by an internal force is thus permitted, the parts returning to their rest positions when the bolt subsequently projects.

The box tube 51 is mounted to rotate about the cross axis 37 and with respect to the rest of the lock unit 7 by a surrounding, flanged bearing drum 70 having a rectangular, central opening and circular ends extending into openings 67 in the side frame plates 42 and 43. Preferably the drum 70 is of a low-friction plastic, so that it always turns easily, even after long use. The amount of turning is limited as the lobes 53 and 54 respectively come against the abutments 39 and 41.

Figure 14:
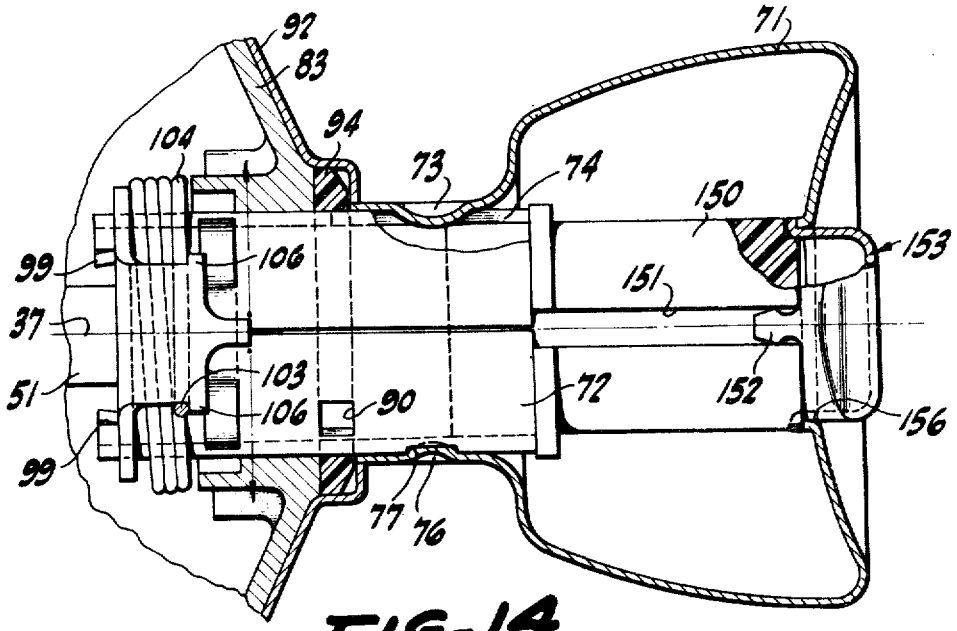
FIG. 14 is a cross-section, the plane of which is indicated by the line 14—14 of FIG. 13.
Figure 15:
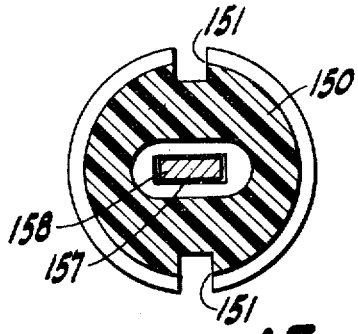
FIG. 15 is a cross-section, the plane of which is indicated by the line 15—15 of FIG. 3.

Rotation of the box tube 51 from one side (the inside) of the door panel 9 is accomplished by rotation of an inside or an inner knob 71 symmetrical about the cross axis 37. The knob is on an inner tube 72 (FIG. 3) also concentric with the axis 37, the knob being held against rotation relative to the tube by an indentation 73 (FIG. 14) seated in an axial groove 74 in the tube. The knob is held against axial movement relative to the inner tube 72 by a dimple 76 extending into a depression 77 in the tube.

Figure 7:
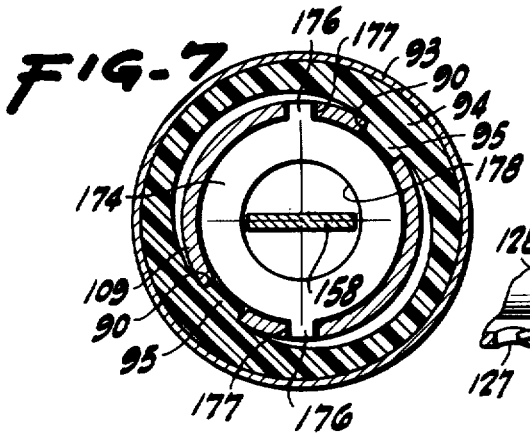
FIG. 7 is a fragmentary cross-section, the plane of section being indicated by the line 7—7 of FIG. 5.

The inner tube 72 near its inner end is supported by and turns in a bearing hub 83 forming part of an inner escutcheon 84 secured against one side of the door panel 9 and overlying one end of a cross bore 86 through the panel 9 along the axis 37 and open to the edge bore 20. Preferably, the inner escutcheon 84 is held in place by a pair of fasteners 87 going through apertured aligning trough extensions 88 on the inner escutcheon and screwed into threaded bosses 89 on an outer escutcheon 91 spanning the other end of the cross bore 86 and abutting the outer face of the door panel. Preferably both of the escutcheons 84 and 91 are provided with thin trim shells 92 and 93 marginally crimped in position and serving to confine anti-friction washers 94 overlying openings 90 (FIG. 7) engaged by lugs 95 on the washers.

Figure 13:
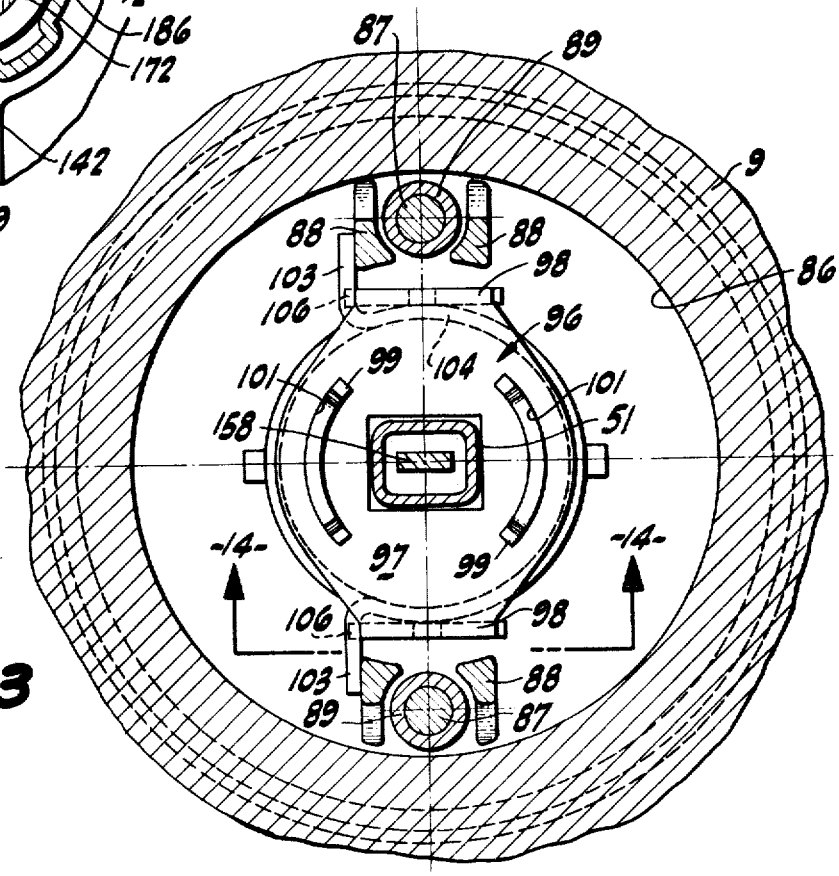
FIG. 13 is a cross-section, the plane of which is indicated by the line 13—13 of FIG. 3.

To interconnect the inner knob tube 72 and the box tube 51 there is provided a partial cup 96 (FIG. 3) having a central plate 97 and a pair of side extensions 98. Tabs 99 (FIG. 13) at the end of the inner tube 72 project through arcuate cut-outs 101 in the central plate 97 and are staked.

In order to restore the inner knob to its normal, central position after it has been rotated in either direction, the side extensions 98 (FIGS. 3 and 13) respectively engage the opposite radial ends 103 of a coil spring 104 positioned by lugs 106 (FIG. 14) on the extensions 98. The spring ends 103 lie against (FIG. 13) the trough extensions 88 projecting from the inner escutcheon 84. When the inner knob is turned, the bolt 24 is retracted and the corresponding spring end 103 is similarly rotated, the other spring end remaining against its extension 88. When the knob is released, the just-tensioned spring restores the knob to the central or neutral position ensured by the spring ends 103 and correspondingly restores the bolt 24.

Figure 11:
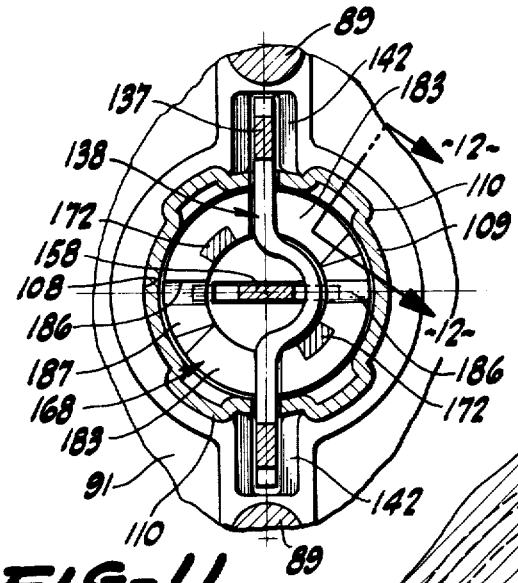
FIG. 11 is a cross-section, the plane of which is indicated by the line 11—11 of FIG. 2.
Figure 12:
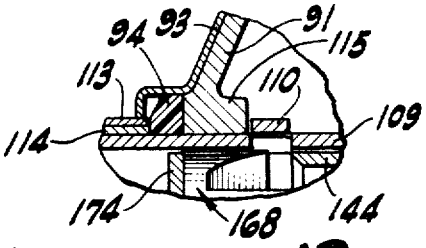
FIG. 12 is a cross-section of a portion of the structure of FIG. 11, the plane of section being on the line 12—12 of FIG. 11.

In a somewhat comparable fashion, the outer escutcheon 91 (FIG. 2) forms a journal 108 for an outer tube 109 concentric with the cross axis 37 and rotatable about that axis. The tube 109 (FIGS. 11 and 12) has radially outstanding axial locating bridges 110 acting against the hub ring 115 (FIG. 12) of the outer escutcheon 91 and so precludes axial withdrawal of the tube 109. Resting on the extended portion of the outer tube is the main shell 111 (FIG. 2) of an outer knob 112, the shell having an inturned flange entering into the end of the tube 109 for stability. The main shell is augmented by a supplemental shell 113 encompassing the hub 114 of the knob 112 and flared to telescope in a rim 116 of the main shell 111.

Figure 6:
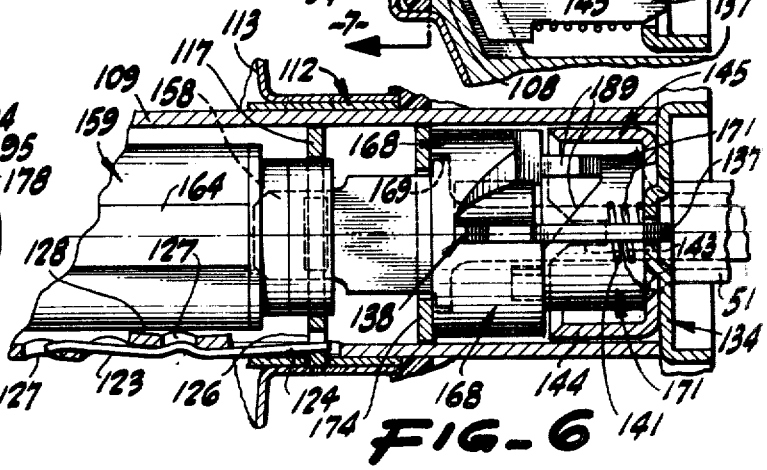
FIG. 6 is a cross-section with portions broken away, the plane of section being indicated by the line 6—6 of FIG. 4.
Figure 8:
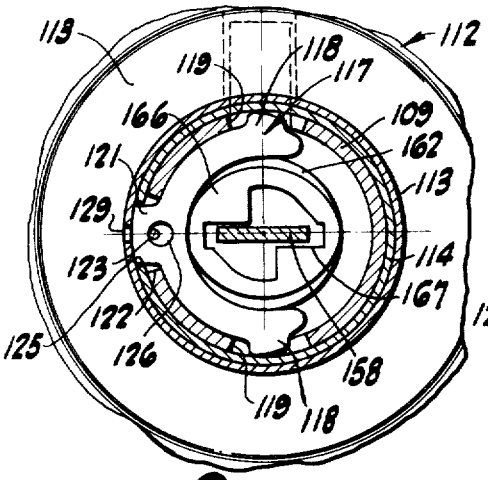
FIG. 8 is a cross-section, the plane of which is indicated by the line 8—8 of FIG. 2, showing the key plug cam in locked position and the flat bar in locked position.

The outer knob 112 is releasably joined to the tube 109 (FIGS. 2, 6 and 8) by a crescent plate 117 having side lugs 118 movable transversely in slots 119 in the tube 109. The crescent plate 117 also has a central lug 121 transversely movable in but circumferentially confined by a slot 122 in the tube 109 and a similar slot 125 in the knob hub 114. A spring wire 123 has a deformable end 124 disposed in an opening 126 in the crescent plate 117 and is anchored by being deformed into apertures 127 in a displaced part 128 of the tube.

When the crescent plate 117 is shifted (to the right in FIG. 8) against the urgency of the spring wire 123 by means of a rod or wire tool acting through an opening 129 in the shell 113 (FIG. 8), the central lug 121 is displaced out of the slot 125, and the outer knob 112 can then be withdrawn from the outer tube 109. By a reverse operation, the outer knob can be axially replaced and locked in position against axial and rotary displacement relative to the tube 109.

Figure 4:
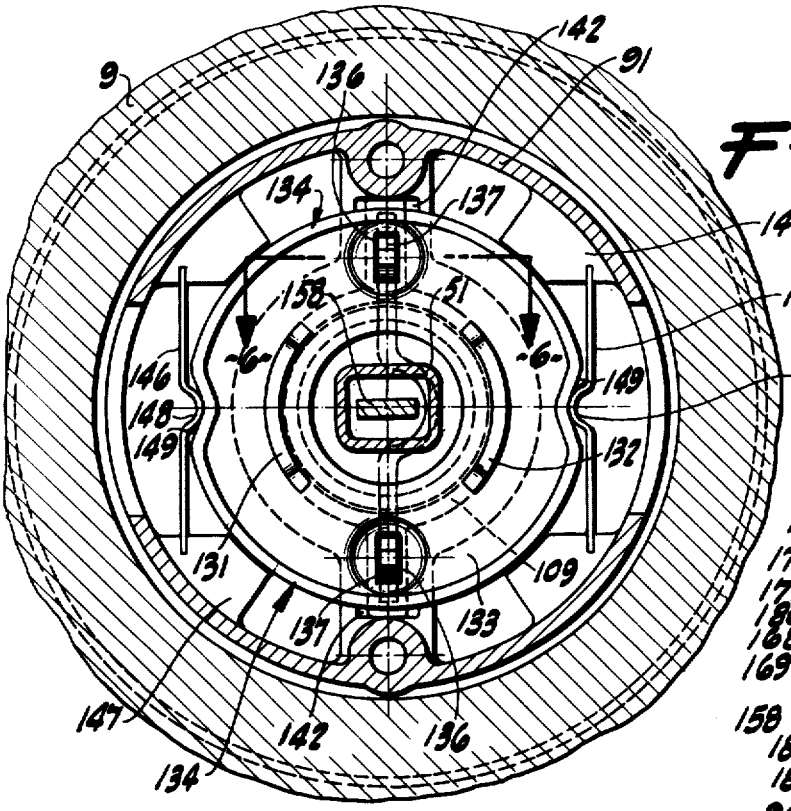
FIG. 4 is a cross-section, the plane of which is indicated by the line 4—4 of FIG. 2.
Figure 5:
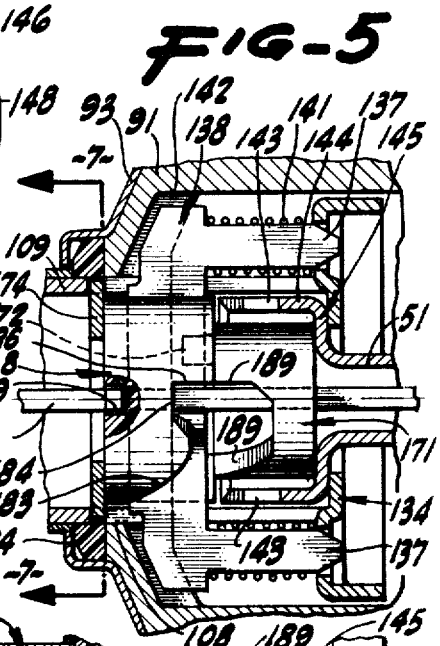
FIG. 5 is a partial view based on FIG. 4 but showing some of the interior parts in side elevation.

Rotation of the engaged outer knob 112 rotates the tube 109. At its inner end, the tube 109 has arcuate tabs 131 and 132 (FIG. 4) extending through a correspondingly pierced wall 133 (FIGS. 2 and 4) of an outer drum 134. Also in the drum 134 are radial slots 136 slidably receiving the tines 137 (FIGS. 2 and 4) of a fork 138 having a generally flat, diametrical plate 139 with a central offset and slidable in slots 177 (FIGS. 2 and 7) in the end of the tube 109. Coil springs 141 surround the tines 137, bear against the drum 134 and against the plate 139 and tend to urge the fork 138 away from the drum 134 and into a leftward position (FIGS. 2 and 5). In this position, the ends of the plate 139 seat in radial notches 142, serving as a first detent, in the outer escutcheon 91. This leftward position of the plate 139 prevents any relative rotary motion between the stationary outer escutcheon 91, the fork 138, the tines 137, the drum 134, and the outer tube 109.

In a rightward position of the fork 138 (shown in FIG. 2 by broken lines), the springs 141 are compressed and the fork plate 139 is entirely out of the notches 142. The tines 137 project further through the slots 136 and, particularly, the fork plate 139 lies in bevelled edge notches 143 (FIG. 5). These notches serve as a second detent and lie in the rim 144 of inner drum 145 constituting an enlargement on the end of the box tube 51. In this rightward position of the fork 138, there is an uncoupling from the outer escutcheon, but the fork 138 is coupled to the box tube 51, so the outer knob 112, the outer tube 109, the drum 134, the fork 138, the drum 145, the box tube 51, and the inner knob 71 all rotate together.

These parts are yieldably retained in rotary, rest position by a pair of leaf springs 146 (FIG. 4) seated in notched lugs 147 on the outer escutcheon 91. The lugs are finished to serve as bearings for the drum 134. The springs 146 centrally have bosses 148 adapted yieldably to seat in notches 149 in the drum 134. Thus the drum and its connected parts can readily be rotated, but near rest position are yieldably urged into an exact location.

In order to control the axial displacement of the fork 138 and so determine whether the fork is in one extreme position seated and locked solely in the notches 142 of the stationary escutcheon 91 or is in another extreme position solely in engagement with the notches 143 of the box tube 51, there is provided a special mechanism. Within the inside knob 71 (FIG. 3), there is a hub 150 having a limited insertion into the end of the tube 72. The hub 150 has a pair of axially extending grooves 151 into which extend flanged lugs 152 on a thumb-turn button 153 having a diametral ridge 154 and nesting within a central opening 156 in the inner knob 71. The hub 150 is thus rotatable by rotation of the button 153. The hub has an elongated, rectangular aperture 157 that easily receives the adjacent part of a flat bar 158 extending along the cross axis 37 and largely disposed and rotatable within the box tube 51.

Figure 1:
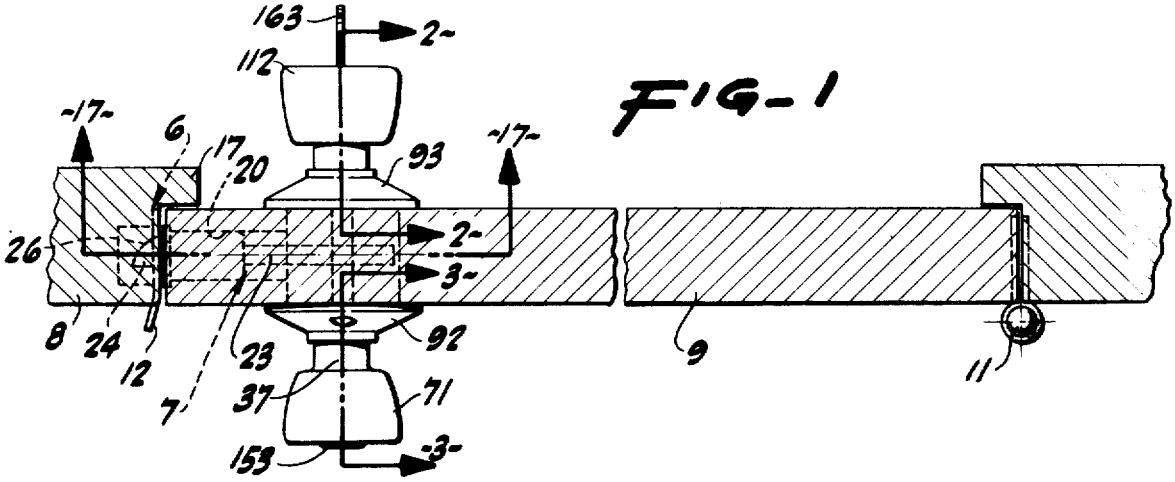
FIG. 1 is a cross-section on a horizontal plane through a door panel and door frame showing the lockset of the invention installed therein.
Figure 16:
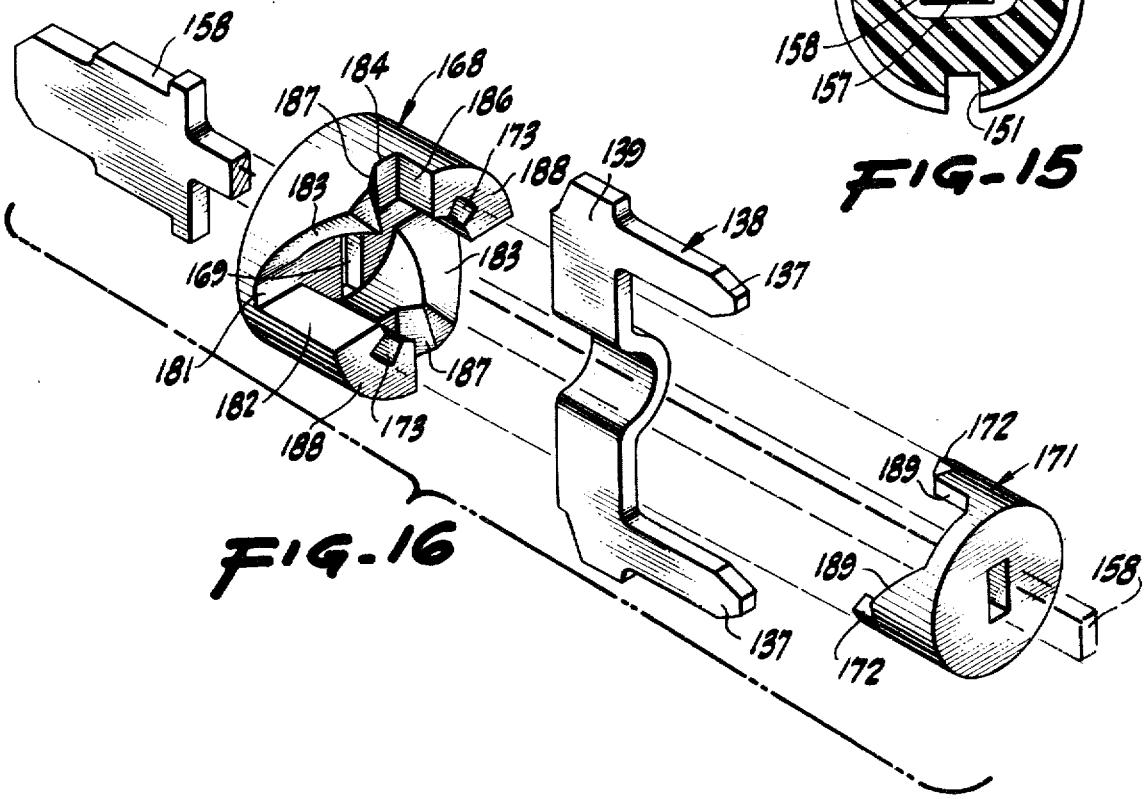
FIG. 16 is an isometric perspective of the fork mechanism and related parts.
Figure 17:
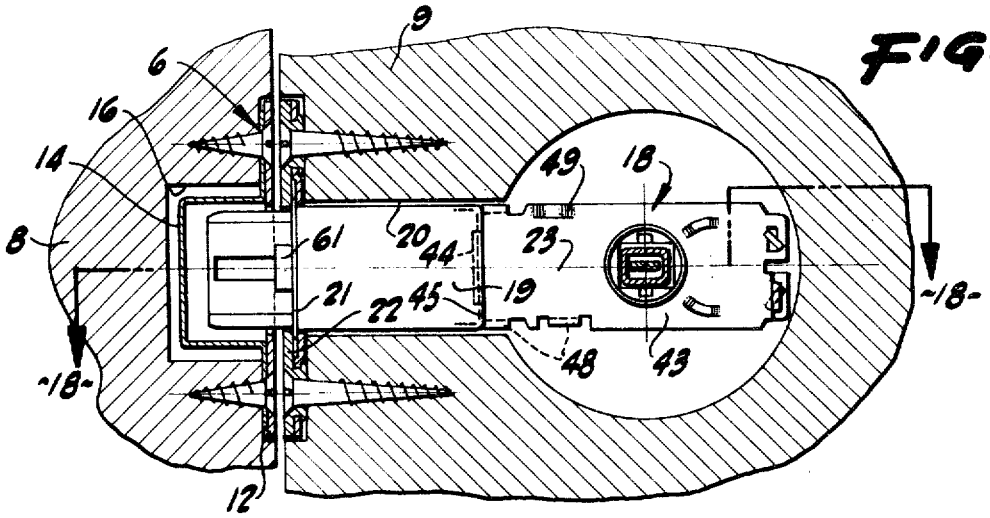
FIG. 17 is a cross-section, the plane of which is indicated by the line 17—17 of FIG. 1.

Not only can the button 153 rotate the flat bar 158 from inside, but also a key mechanism 159 (FIG. 2) can rotate the flat bar 158 from outside. The key mechanism 159 is substantially standard and includes a cylindrical housing portion 161 in the tube 109. A rotor plug 162 having a keyway is rotatable by a key 163 (FIG. 1) about the axis 37. The housing 161 also includes a pin tumbler wing 164 containing pin tumblers in the normal way for accepting only a properly cut key. With a key in the plug 162, the key and plug can be rotated together and so also rotate the flat bar 158, the outer end of which (FIGS. 2 and 16) lies in a rectangular recess in the plug 162.

Figure 9:
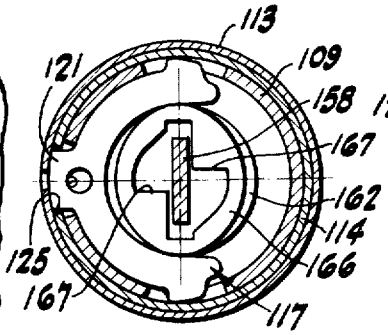
FIG. 9 is a cross-section like FIG. 8 but with the key plug cam in unlocked position and the flat bar in unlocked position.
Figure 10:
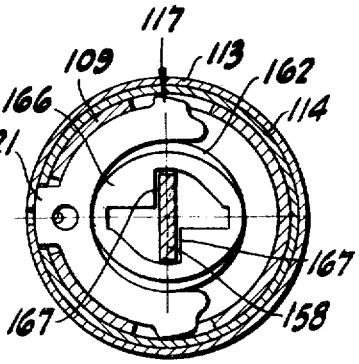
FIG. 10 is a cross-section like FIG. 8 but with the key plug cam in locked position and the flat bar in unlocked position.

One of the functions of the rotary key plug 162 is to govern the interconnection of the outer knob 112 and the tube 109. As shown in FIGS. 2, 8, 9 and 10, the rotor plug 162 is extended by a specially characterized cam 166 rotatable therewith. The exterior of the cam 166 (FIG. 8) is approximately elliptical and the interior is in parts cut away to be spaced from the flat bar 158 and is in parts contoured to afford diagonally opposite abutments 167 (FIG. 9) for the flat bar 158. This affords a speci..., lost-motion connection. With this arrangement, when the cam 166 is disposed by the rotor plug 162 in either of the positions shown in FIGS. 8 and 10, the cam 166 is in locked position in abutment with the projected crescent plate 117. The central lug 121 then cannot be depressed, thus precluding removal of the knob 112 from the tube 109. But when the parts are in unlocked condition by operation of the key 163 and corresponding rotation of the cam 166, as shown in FIG. 9, then the crescent plate 117 can readily be depressed, freeing the outer knob for removal from the tube 109.

Rotation of the flat bar 158 has a locking and an unlocking function. Engaging and rotatable together with the flat bar 158 is a cam drum 168 (FIGS. 2 and 16) having a rectangular opening 169 for that purpose and adapted axially to abut a ring 171 having lugs 172 slidable into slots 173 in the end of the cam drum 168. The cam drum is backed up by a stop washer 174 (FIGS. 5 and 7) having external lugs 176 adapted to seat in the end of axial slots 177 in the tube 109 and having a central opening 178 around the flat bar 158. Withdrawal of the lugs 176 axially from the slots 177 frees the washer for removal from its usual position produced by the trim shell 93 and washer 94. With the washer 174 in place, the cam drum 168 and the ring 171 are held against unwanted axial motion.

The cam drum 168 has a specially characterized leading rim of a diametrically symmetrical configuration. There is a cross slot 181 (FIG. 16) on one side bounded by an axially extending planar face 182 and on the other side bounded by a helical surface 183. At about ninety degrees to the slot 181, there is a slot 184 on one side bounded by an axially extending radial surface 186 and on the other side bounded by a helical surface 187. These various surfaces end at a cross face 188 having the notches 173 therein. The cam drum 168 end surfaces and the complementary end surfaces 189 of the ring 171 cooperate with the interposed plate 139 of the fork 138 to move the fork 138 axially as the cam drum 168 and the engaged ring 171 are turned by the flat bar 158.

The result is that when the flat bar 158 is rotated, the cam drum 168 and the cam ring 171 correspondingly rotate and the fork 138 is axially advanced (to the right in FIGS. 2 and 16) against the urgency of the springs 141 and to an extent sufficient to move the fork plate 139 out of the escutcheon locking notches 142 and so free the fork and drum 134 from the stationary outer escutcheon 91. At the same time, the radial plate 139 of the fork 138 enters into the diametrical notches 143 in the rim 144 at the outer end of the box beam 51. This ensures rotation of the box beam 51 concurrently with further rotation of the plug 162 and the flat bar 158. In this way the previously spring-locked outer knob 112 is unlocked by the key 163 (or by rotation of the button 153). The knob 112, when rotated, makes the cam lobe 54 and the hook plate 33 effective for retraction of the latch bolt 24. When exterior rotary force is removed from the actuated knob 112, the knob is restored to its original rotated position by action of the spring 104. This knob rotation also rotates the cam drum 168 and so releases the cam plate 138 to be ejected from the notches 143 under influence of the springs 141. The latch bolt 24 is then free to be projected again by the spring 35.

We claim:

1. A lockset comprising a main frame having a first detent, means for mounting said main frame on a door panel, an inner tube subject to a second detent, means for mounting said inner tube on said main frame for rotation about an axis, a bolt, means for mounting said bolt on said main frame for reciprocation, means for interconnecting said inner tube and said bolt for reciprocation of said bolt by rotation of said inner tube, an outer tube rotatable about said axis relative to said main frame, a slide plate, means for interrelating said slide plate and said outer tube for relative sliding motion and against relative rotary motion, and means for sliding said slide plate relative to said outer tube between a first position engaged with said first detent and disengaged from said second detent and a second position disengaged from said first detent and engaged with said second detent.

2. A lockset as in claim 1 in which said means for sliding moves said slide plate along said axis.

3. A lockset as in claim 1 in which said means for sliding said slide plate includes a cam having a helical surface.

4. A lockset as in claim 3 including means for urging said slide plate into abutment with said helical surface of said cam.

5. A lockset as in claim 4 in which said slide plate urging means includes a spring.

6. A lockset as in claim 3 in which said helical cam is rotatable on said axis.

7. A lockset as in claim 6 including a flat bar extending along said axis within said tubes, means for mounting said flat bar for rotation about said axis, and means for connecting said cam for rotation with said flat bar.

8. A lockset as in claim 7 including an inner knob, means for mounting said inner knob on said main frame for rotation about said axis, and means in said inner knob and rotatable relative thereto for rotating said flat bar.

9. A lockset as in claim 7 including an outer knob, means for mounting said outer knob on said main frame for rotation about said axis, and key-actuated means in said outer knob for rotating said flat bar.

10. A lockset for use on a planar door panel comprising a main frame including an inner escutcheon and an outer escutcheon, said outer escutcheon having notches therein, means for holding said escutcheons on said door panel in alignment on an axis normal to said panel, an outer tube rotatable in said outer escutcheon about said axis and having axial slots therein, an outer drum on the end of said outer tube and having radial slots therein, a box tube rotatable within said outer escutcheon about said axis, an inner drum on the end of said box tube and having edge notches therein, a plate extending across said axis and movable in said axial slots, forks on said plate and movably disposed in said radial slots, means for moving said plate along said axis and into one position in engagement with said notches in said outer escutcheon and into another position in engagement with said edge notches, and means for urging said plate along said axis and out of said edge notches in said inner drum and into said notches in said outer escutcheon.

11. A lockset as in claim 10 in which said means for urging said plate along said axis into engagement with said edge notches is a cam mounted against axial displacement and to rotate about said axis in engagement with said plate, and a flat bar in said tube and rotatable about said axis and in driving engagement with said cam.

12. A lockset as in claim 10 including an axially fixed inner tube rotatable in said inner escutcheon about said axis, said box tube being extended along said axis and connected to rotate with said inner tube, and means on said box tube adapted to interengage with said plate.

13. A lockset as in claim 12 in which said box tube is connected to said inner tube by a partial cup having axial side extensions, axial trough extensions on said inside escutcheon adjacent said side extensions, and a spring around said inner tube and having tangential ends adapted to abut said side extensions and said axial trough extensions.

14. A lockset comprising an outer escutcheon having a notch therein, an outer tube having axial slots therein and rotatable in said outer escutcheon about an axis, a disc fixed on said outer tube, an inner escutcheon, means for locating said inner escutcheon on said axis relative to said outer escutcheon, an inner tube rotatable in said inner escutcheon about said axis, a box tube rotatable with said inner tube about said axis, means on said box tube having an edge notch therein, and means movable in said outer tube slots axially between a first position engaging said notch in said outer escutcheon and a second position disengaged from said notch in said escutcheon and engaged with said edge notch.

15. A lockset as in claim 14 including a spring acting between said disc and said axially movable means for urging said axially movable means into said first position.

* * * * *